United States Patent [19]

Ching-Liang

[11] Patent Number: 4,856,776

[45] Date of Patent: Aug. 15, 1989

[54] COIL SPRING EXERCISER

[76] Inventor: Liu Ching-Liang, No. 63, Ta Jen Rd., Herng Shan Tsan, Yann Chaur Hsiang, Kaohsiung Hsien, Taiwan

[21] Appl. No.: 140,228

[22] Filed: Dec. 31, 1987

[51] Int. Cl.[4] ..... A63B 21/00; A63B 21/02

[52] U.S. Cl. ..... 272/142; 272/135; 272/137

[58] Field of Search ..... 272/142, 135, 137, 67, 272/143, 901, 138, 125, 68, 114, 65, 116; 231/2.1–6

[56] References Cited

U.S. PATENT DOCUMENTS

| | | | |
|---|---|---|---|
| 743,204 | 11/1903 | Terry | 272/142 |
| 992,272 | 5/1911 | Singer | 272/142 |
| 1,538,845 | 5/1925 | Titus | 272/142 |
| 2,714,008 | 7/1955 | Urban . | |
| 3,003,764 | 10/1961 | Yovanovitch | 272/68 |
| 3,451,675 | 6/1969 | Burzenski . | |
| 3,552,371 | 1/1971 | Kahelin . | |
| 4,162,063 | 7/1979 | Nissen et al. | 272/65 X |
| 4,249,729 | 2/1981 | Gabrielidis | 272/135 |
| 4,328,964 | 5/1982 | Walls . | |
| 4,489,937 | 12/1984 | Kong . | |
| 4,651,985 | 3/1987 | Salisbury | 272/68 |

FOREIGN PATENT DOCUMENTS

| | | | |
|---|---|---|---|
| 124746 | 10/1901 | Fed. Rep. of Germany | 272/135 |
| 352704 | 3/1920 | Fed. Rep. of Germany | 272/114 |
| 2587 | of 1899 | United Kingdom | 272/135 |

*Primary Examiner*—Richard J. Apley
*Assistant Examiner*—Franklin L. Gubernick
*Attorney, Agent, or Firm*—Harness, Dickey & Pierce

[57] ABSTRACT

A dyna-bender includes an internal coil spring; an external coil spring, coaxially surrounding the internal coil spring, having an intermediate portion spaced from the internal coil spring at a predetermined distance, and two opposite end portions having diameter-reduced turns for being sleeved tightly on the internal coil spring; and two hollow plastic grips each having an open inner end which is heat pressed to sleeve tightly on one of the end portions of the external coil spring.

2 Claims, 2 Drawing Sheets

COIL SPRING EXERCISER

BACKGROUND OF THE INVENTION

This invention relates to a dyna-bender, and more particularly to one which has a minimum number of parts.

To exercise arms and wrists, various dyna-benders have been developed. For example, U.S. Pat. No. 4,489,937 disclosed a safety dyna-bender as shown in FIG. 1. The safety dyna-bender has two handle pipes 11 and 12 for connecting two hollow grips 13 and 14 to two ends of a coil spring 10. In this safety dyna-bender, a center cord (not shown) interconnects the inner walls of the hollow grips 13 and 14 for effectively protecting the user against any unexpected accidents resulting from the breaking of the coil spring 10 during exercise. To mount the center cord on the grips 13 and 14, cup-shaped positioning anchors (not shown) are provided in the grips 13 and 14. These anchors complicate the dyna-bender thereby increasing its manufacturing cost. Also, the handle pipes 11 and 12, which are provided to interconnect the coil spring 10 and the grips 13 and 14, further increase its manufacturing cost. The coil spring 10 has two distal ends A and B which are undesirably exposed to the exterior of the handle pipes 11 and 12. In addition t their unsightly outer appearance, the exposed ends A and B of the coil spring 10 sometimes injure the user. When the total length of the dyna-bender is fixed, if the handle pipes are provided, the length of the coil spring will be shortened, reducing the exercise effect.

U.S. Pat. No. 2,714,008 disclosed a dyna-bender shown in FIG. 2. It includes an external coil spring 15 and an internal coil spring 16 extending through the external coil spring 15. Although the internal coil spring 16 increases the exercise effect for the user, additional elements are needed to secure the ends of the internal coil spring 16 to the grips. In addition, the exposed ends of the coil spring and the handle pipes are still present.

SUMMARY OF THE INVENTION

It is therefore the main object of this invention to provide a simple dyna-bender which has a high ratio of length of the coil spring to total length of the dyna-bender for effectively exercising arms and wrists.

Another object of this invention is to provide a safety dyna-bender which is of simple construction.

According to this invention, a dyna-bender includes an internal coil spring; an external coil spring, surrounding coaxially the internal coil spring, having an intermediate portion spaced from the internal coil spring at a predetermined distance, and two opposite end portions having diameter-reduced turns for being sleeved tightly on the internal coil spring; and two hollow plastic grips each having an open end which is heat pressed to sleeve tightly on one of the end portions of the external coil spring.

Preferably, the distance between the internal coil spring and the intermediate portion of the external coil spring is selected so that it is difficult to contact said internal coil spring with the external coil spring during exercise, thereby minimizing the noise resulting from the friction therebetween.

BRIEF DESCRIPTION OF THE DRAWINGS

Other features and advantages of this invention will become apparent in the following detailed description of a preferred embodiment of this invention with reference to the accompanying drawings in which.

DETAILED DESCRIPTION OF THE PREFERRED EMBODIMENT

Figure 1:
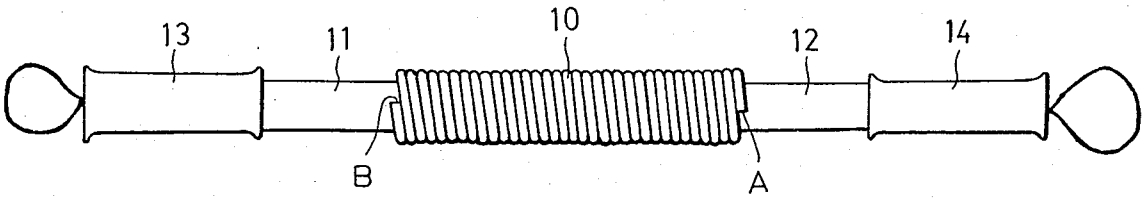
FIG. 1 PRIOR ART
FIG. 1 is an elevational view of a conventional dyna-bender.
Figure 2:
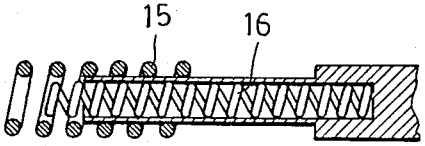
FIG. 2 PRIOR ART
FIG. 2 is a schematic sectional view showing part of another conventional dyna-bender.
Figure 3:
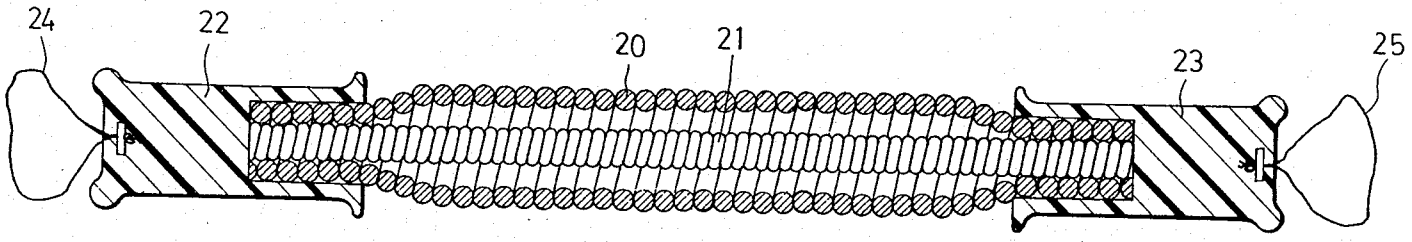
FIG. 3 is a sectional view of a dyna-bender according to this invention.

Referring to FIG. 3, a dyna-bender of this invention includes an external coil spring 20 which surrounds a internal coil spring 21 in a coaxial relation. The external coil spring 20 has an intermediate portion spaced from the internal coil spring 21, and two end portions having diameter-reduced turns for being sleeved tightly on the internal coil spring 21. As illustrated, the external coil spring 20 and the internal coil spring 21 are the same length.

Sleeved on the diameter-reduced ends of the external coil spring 20 are two hollow plastic grips 22 and 23 each of which has a closed outer end and an open inner end. The inner ends of the grips 22 and 23 are heat pressed to sleeve tightly on the external coil spring 20 so that the external coil spring 20 and hence the internal coil spring 21 cannot be removed from either of the grips 22 and 23.

Each of the grips 22 and 23 is provided with a wrist ring 24, 25 on its outer end in a known manner.

Figure 4:
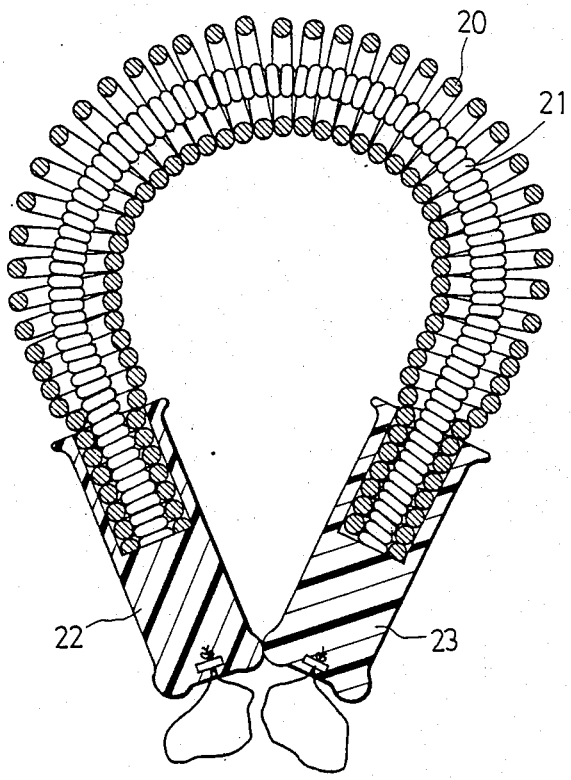
FIG. 4 is a sectional view showing the dyna-bender of this invention when it is bent.

As illustrated, in this embodiment, the diameter of the internal coil spring 21 is only one fourth of that of the intermediate portion of the external coil spring 20 so that it is difficult to contact the external coil spring 20 with the internal coil spring 21 when the dyna-bender is bent, as shown in FIG. 4. The noise resulting from the friction between the external coil spring 20 and the internal coil spring 21 is thus minimized.

As explained in the foregoing, in the dyna-bender of this invention, the external and internal coil springs 20 and 21 facilitate the promotion of the exercise effect. Because the springs 20 and 21 are directly connected to the grips 22 and 23, the ratio of the length of the springs to the total length of the dyna-bender is increased in comparison with the aforementioned conventional dyna-benders, thereby further increasing the exercise effect. Even if one of the springs 20 or 21 is broken during exercise, the grips 22 and 23 will still be connected by the other of the springs 20 and 21.

Furthermore, according to this invention, because the grips 22 and 23 are heat pressed to sleeve on the springs 20 and 21, additional anchoring elements are not needed. Accordingly, the dyna-bender of this invention has a low manufacturing cost.

With this invention thus explained, it is apparent that numerous modifications and variations can be made without departing from the scope and spirit of this invention. It is therefore intended that this invention be limited only as indicated in the appended claims.

I claim:

1. A coil spring exerciser an internal coil spring;

an external coil spring, coaxially surrounding said internal coil spring, having an intermediate portion spaced from internal coil spring at a predetermined distance whereby said spacing reduces frictional contact between the springs during bending of the device, and two opposite end portions having diameter-reduced turns for being sleeved tightly on said internal coil spring whereby said sleeving fixes the ends of the internal spring relative to the ends of the external spring; and two hollow plastic grips each having an open end which is heat pressed to sleeve tightly on of said end portions of said external coil spring.

2. A coil spring exerciser as claimed in claim 1, wherein said internal and external coil springs are the same length so that said external coil spring surrounds said internal coil spring along their full length.

* * * * *

UNITED STATES PATENT AND TRADEMARK OFFICE

CERTIFICATE OF CORRECTION

PATENT NO. : 4,856,776

DATED : August 15, 1989

INVENTOR(S) : Ching-Liang LIU

It is certified that error appears in the above-identified patent and that said Letters Patent is hereby corrected as shown below:

ON THE TITLE PAGE, under "UNITED STATES PATENT", "Ching-Liang" should be --Liu--.

ON THE TITLE PAGE, under "Inventor", "Liu Ching-Liang" should be --Ching-Liang Liu--.

Column 1, line 28, "t" should be --to--.

Column 2, line 63, Claim 1, after "exerciser" insert --comprising--.

Column 2, line 67, Claim 1, after "from" insert --said--.

Column 4, line 1, Claim 1, after "on" insert --one--.

Signed and Sealed this

Twelfth Day of June, 1990

*Attest:*

HARRY F. MANBECK, JR.

*Attesting Officer*

*Commissioner of Patents and Trademarks*